US007481629B2

(12) United States Patent
Winter

(10) Patent No.: US 7,481,629 B2
(45) Date of Patent: Jan. 27, 2009

(54) RADIAL PISTON PUMP

(75) Inventor: Jens Winter, Meckenbeuren (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 825 days.

(21) Appl. No.: 10/963,992

(22) Filed: Oct. 13, 2004

(65) Prior Publication Data

US 2005/0079065 A1 Apr. 14, 2005

(30) Foreign Application Priority Data

Oct. 14, 2003 (DE) ..... 103 47 715

(51) Int. Cl.
*F04B 1/04* (2006.01)
*F04B 39/10* (2006.01)
*F01B 1/00* (2006.01)

(52) U.S. Cl. ..... 417/273; 417/547; 92/72

(58) Field of Classification Search ..... 417/273, 417/547; 92/72
See application file for complete search history.

(56) References Cited

U.S. PATENT DOCUMENTS 5,876,186 A * 3/1999 Stiefel ..... 417/273
6,077,056 A 6/2000 Gmelin
6,250,893 B1 * 6/2001 Streicher ..... 417/273
6,347,574 B1 * 2/2002 Guentert et al. ..... 92/72
6,350,107 B1 * 2/2002 Hamutcu ..... 417/273
6,619,187 B2 * 9/2003 Plaga ..... 92/72
2002/0185002 A1 12/2002 Herrmann

FOREIGN PATENT DOCUMENTS

DE 43 22 560 A1 1/1994
DE 43 36 673 A1 5/1995
DE 92 19 086 U1 10/1997
DE 197 05 205 A1 8/1998
DE 101 26 151 A1 12/2002
DE 101 28 066 A1 12/2002

* cited by examiner

*Primary Examiner*—Devon C Kramer
*Assistant Examiner*—Patrick Hamo
(74) *Attorney, Agent, or Firm*—Davis & Bujold, P.L.L.C.

(57) ABSTRACT

Proposed is a radial piston pump with a pump body, in which pistons and cylinders are circumferentially arranged about a driven eccentric, which the pump possesses a faceted slip ring (9) assembly which has an inner diameter and a polygonal outer diameter, the polygon consists of straight, axial parallel surfaces (13), the number of which represents the number of pistons (2) contained in the radial piston pump.

8 Claims, 2 Drawing Sheets

RADIAL PISTON PUMP

This application claims priority from German Application Ser. No. 103 47 715.2 filed Oct. 14, 2003.

FIELD OF THE INVENTION

The present invention concerns a radial piston pump, with a pump body, in which piston and cylinders are radially placed about a driven eccentric.

BACKGROUND OF THE INVENTION

Radial piston pumps have been extensively used in motor vehicles for transporting lubricating oil, pumping fuel, and as pressure generating means for hydraulically operated servo-mechanisms. Such pumps find further use as hydraulic pumps for power steering, shock absorbers, clutches and continuous transmissions, automatically controlled transmissions, and hydraulically operated driving and auxiliary equipment, and for operational machines and the like. Radial piston pumps are predominately installed in cases where a higher hydraulic pressure level is necessary.

Serving as pumps of the displacement type, radial piston pumps do not deliver a pumped medium in continuous flow, but irregularly, in partial volumes per revolution of a driven eccentric. The cyclically transported volumes give rise to pressure variations and pulsations, both at the intake and output ports of the pump. The said pulsations inlet and outlet overlap, due to the opening and closing of the of the pump chambers, that is to say, the cylinders. The impacts are particularly severe if, during operation with volute spring activated inlet and outlet valves, suddenly spaces are made available which exhibit large pressure differentials. Beyond this, as rule, large pressure swings also occur, if a system operates at high pressure, or if a cylinder is partially filled.

If pressure in a cylinder attains an opening pressure of the annular volute spring of a valve, then the valve lifts away from its seat, and the hydraulic fluid, for example pressurized oil, is pushed into a sump. If the pressure in the cylinder falls below the closure pressure of the spring loaded valve, then this valve impacts once again on the seat and causes thereby a loud hammering noise. This performance repeats itself at every rotation of the driven eccentric, in accord with the number of piston-cylinder combinations of a pump.

The noise is just that much louder, as the opening and closure process becomes more dynamic. Also influencing the said hammering noise are the related opening pressures and closing pressures and as well, the rate of increase of pressure at the instant of opening generates noise. If these values are very high, then the spring loaded valve will be lifted instantaneously very far from its seat and accordingly return to its seated position with considerable force. The pressure impacts of all pistons produce a general noise, which resounding from the body of the pump, radiates as audible air-borne noise.

In order to both reduce and mitigate the peaks of the pressure impacts, and also to reduce the noise generation of the radial piston pump, there is proposed in DE A 43 36 673, a radial piston pump, which has a plurality of pistons set into corresponding cylinder borings in a pump housing, wherein each piston is loaded by a spring, which spring abuts against a detent. The drive shaft is axially affixed to an eccentric, upon which a slide bushing is placed. Between one inner slip ring, which is pushed onto the said slide bushing, and a concentric outer slip ring, is located a damping element, which, for example, is designed as a flat, compression spring. Upon rotation of the eccentric, in this way, the respective piston which is expelling oil under pressure can, to some extent, act resiliently against the assigned section of the slip ring, so that the pressure spike normally occurring at the beginning of the pressure thrust can be reduced in intensity.

In another published embodiment, the damping element possesses the shape of slotted annular spring, wherein, equally distributed projections supportingly oppose one another across the inner and outer diameters of said annular spring. The supporting projections permit sufficient clearance between them, so that the particular piston making the thrust can resiliently modify itself.

In yet another embodiment an elastic ring is inserted between the two slip rings. The said elastic ring can well be made of rubber and be vulcanized onto both sides of the slip ring. Instead of a rubber ring, this disclosure also allows that, between the inner and the outer slip rings, an annular ring may be inserted, which is again vulcanized, but consists of a combination of multiple straight sections.

In DE A 101 26 151 a slip ring for a radial piston pump is described, which consists of an inner ring and a thereto coaxially arranged outer ring, between which a damping element is interposed. The damping element is constructed as being of "one piece" and has on both sides, respectively, a bulged rim, which lies against the side rim of the inner ring against the outer circumference thereof, and at the rim of the outer ring within the inner circumference thereof, whereby, between the two said bulged rims, a connecting structure is provided, which, for example, can be formed by an additional damping ring, which is connected with the said bulged rim by means of fabricated webs. In addition, it is possible, that by appropriate formation of the damping element between the inner ring and the outer ring, chambers are created, into which a filling fluid may be introduced, so that the rigidity of the slip rings can be made variable.

To this purpose, along the outer circumference of the damping element between the edge bulges, a plurality of chambers are provided between the inner and the outer ring. The individual said chambers possess an inlet port for the liquid to be drawn in, the said liquid being, for example, oil, so that when the said oil is to be drawn in at low temperatures, by means of filling the chambers of the slip rings, the elasticity thereof is diminished and thereby, by means of the eccentricity of the eccentric a defined piston thrust cannot, or nearly cannot, be affected by the elasticity of the slip rings.

Also disclosed in this publication, in order to reduce noise from radial piston pumps, elastomers are interposed as a layer between the driven eccentric and the pistons, which latter are arranged in a star shape. This layer insertion is made in particular in the form of elastomer slip rings, which are inlaid between the driven eccentric and an outer slip ring. The said elastomer slip ring can be put in place by simply being laid in position, or by being impressed, or by vulcanization onto a contiguous part. First, the damping characteristic of these rings, which, for instance, generates itself from the elasticity of their construction, reduces the pressure increase gradient in an individual cylinder, which is the cause for the objectionable noise and pulsation development. Second, that property of reducing in the transmission, both the noise intensity and its radiation from the pump body, is improved by the insertion of the said elastomer components.

The conventional slip ring assembly for radial piston pumps, as it is applied generally for a continuous and automatic transmission, i.e., the so-called CFT-transmission, still exhibits the disadvantage of considerable weight, so that this causes an imbalance in the gear train and leads to vibrations of the transmission.

SUMMARY OF THE INVENTION

The purpose of the present invention is accordingly, to create a radial piston pump with a slip ring assembly so conceived, that an imbalance caused by the slip ring assembly and transferred by the radial piston pump to the transmission and thereafter to the vehicle, is substantially reduced, so that the vibrations are diminished and brought to an uncritical level.

The invention also bases itself on a radial piston pump with a pump body, in which pistons and cylinders radially encompass a driven eccentric, whereby an individual piston thereof, in the course of a suction thrust, draws a fluid into its respective cylinder through an inlet port opening thereof. Conversely, in the course of a pressure thrust, the said piston causes the fluid be expelled through a check valve into a sump. Further this invented radial piston pump possesses a slip ring assembly, which peripherally encircles the eccentric. The slip ring assembly consists, in accord with the invention, of a laterally faceted slip ring, with a cylindrical inner opening having a diameter and a polygonal outer periphery with an effective diameter, whereby the corresponding polygon consists of axially parallel, facets, angularly joined together. The number of the described facets equals the number of the pistons of the radial piston pump.

In an advantageous embodiment, the said polyhedral slip ring is axially provided with a groove on both the described inside and outside.

For a more effective diminution of the inherent weight, it is possible to, in an advantageous manner, to provide the faceted slip ring with a multiplicity of penetrative borings.

In another favored embodiment, control edges are applied to the straight line, axis-parallel faces of the polygonal sides, which serve in altering the pressure increase gradient.

The invention further provides, that instead of the conventionally used circular slip ring assembly, the said polyhedral faceted slip ring is used, which, the outer periphery of which provides abrasively ground surfaces, which are presented to the contact surfaces of pistons of a radial piston pump.

The so faceted slip ring is held in position by the force of the piston springs and can rotate, in its assigned path, only that direction derived from the driven eccentric. Thereby, the rotational movement of the driven eccentric is converted to a translational motion of the pistons.

Fluid is drawn in during a suction thrust as the pistons retract from the intake ports in the cylinders. Conversely, during a pressure thrust in the cylinder chambers, pressure is generated, whereby the fluid is transported outward into a sump. So that lubrication remains assured between the contacting surfaces of the piston and those of the faceted slip ring during the operation, the bases of the pistons are advantageously provided with a centrally located lubrication boring. Thereby, when pressure builds up in the cylinder, an additional damping by means of the oil between the faceted slip ring and the piston base is achieved. This produces the same effect as that mentioned in the introductory passages in connection with DE A 43 36 673 regarding a proposed springlike ring in a conventional slip ring assembly.

In the case of the invention, an advantage is attained, in that the imbalance, which a radial piston pump can transmit to the vehicle, is reduced because of the small weight of the faceted slip ring, with the result, that even the vibration is diminished, i.e. diminished to a non-critical, operational point.

Further, by means of the lesser weight of the faceted slip ring and by the reduced dynamic friction between the contacting surfaces of pistons and a slip ring, the operational efficiency is improved. The losses due to the spring damping, such as could occur in the case of the conventional slip ring assembly, which has the ring spring, are eliminated by the use of the invented faceted slip ring. This leads to an improvement of the efficiency.

The noise characteristic of the pump with a faceted slip ring, which encompasses the driven eccentric, is seen as being muffled. This, once again, offers advantages in regard to the rating of the pump as to noise level.

Also the stability of the radial piston drive, in accord with the invention, is substantially improved as compared to the conventional slip ring assembly.

In a particularly advantageous manner, the pressure increase gradient of the radial piston pump can be optionally changed by the provision of control edges on the axially parallel, straight surfaces of the faceted slip ring, whereby the influence on the level of the noise can be variably adjusted.

By means of corresponding dimensioning of the boring in the piston base the development of the lubrication film between the contacting surfaces can be optimized.

Circularly disposed, ring grooves in the piston base can be provided, which would improve the lubrication film between the contacting surfaces to an even greater extent.

It is further also possible, to combine the invented faceted slip ring with a ring spring, as this has been disclosed in the formerly mentioned DE 43 36 673.

An adjustment of the helical spring rate in the pistons can serve the purpose of minimizing the tendency of the slip rings to tilt.

Finally, it is to be emphasized, that by virtue of the said provided boring in a piston base, the fabrication of pistons by means of a deep draw process is greatly facilitated, whereby production cost savings in a substantial amount can be expected.

BRIEF DESCRIPTION OF THE DRAWINGS

In the following, the invention will be described and explained in greater detail with the aid of the drawing, in which both the state of the technology as well as an advantageous embodiment example of the invention are presented.

DETAILED DESCRIPTION OF THE INVENTION

Figure 1:
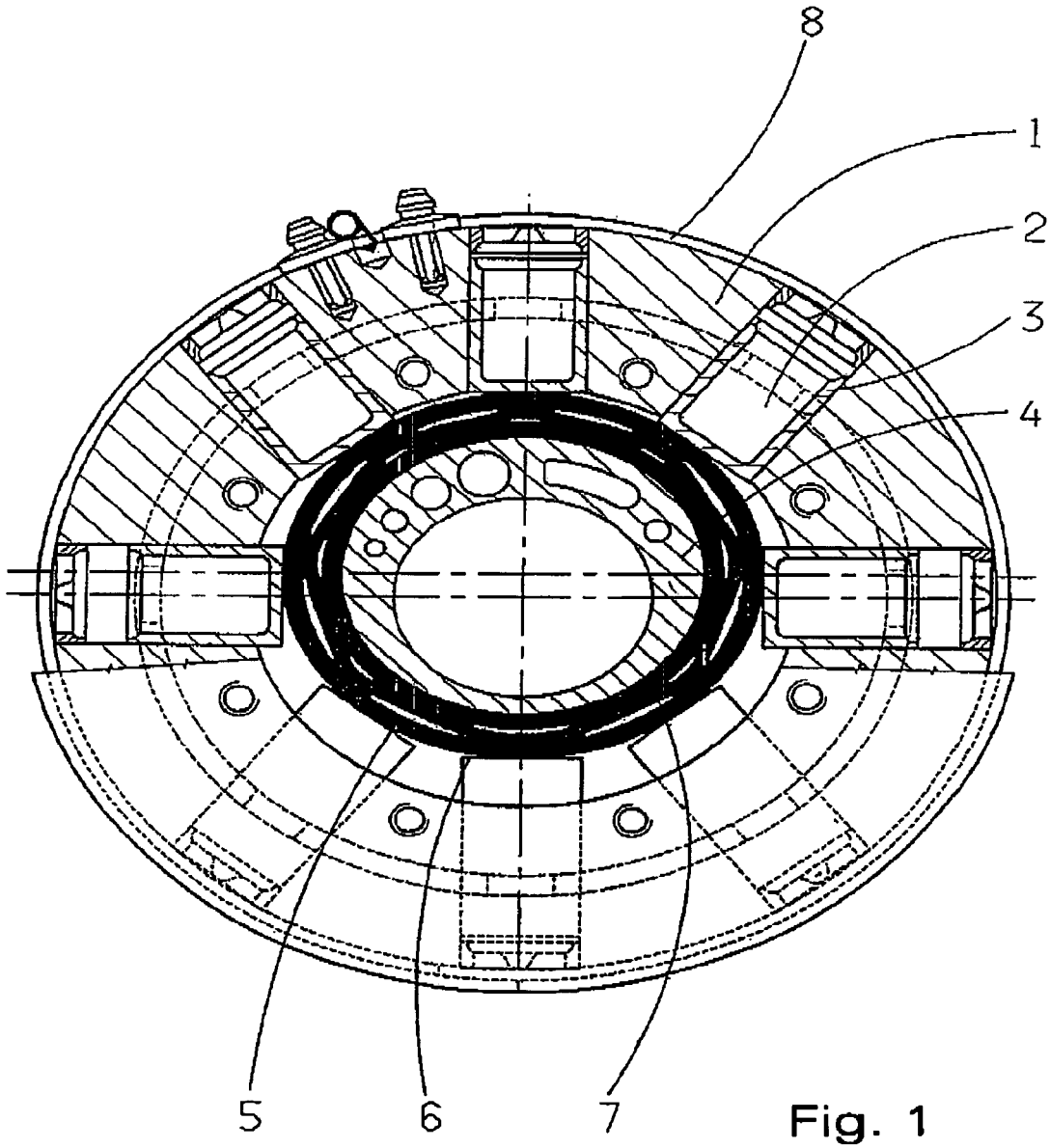
Fig. 1 Prior Art
FIG. 1 shows a radial section through a conventional radial piston pump with a slip ring assembly which exhibits a ring spring.

The pump body is designated by the reference number 1, in which said body a plurality of cylinders 3 are placed, and in the said cylinders 3 are respectively located pistons 2. Each piston 2 is loaded by a spring, which abuts itself against a stopper. A spring 8, in ring shape, encloses all stoppers and closes outlet borings to inner spaces leading to a collecting annular groove. The ring spring, in this way, forms a check valve for each cylinder.

In this conventional radial piston pump, an eccentric 4 is mounted upon a drive shaft D, whereby the driven eccentric 4 is surrounded by a slip ring assembly 5, 6 and 7. The said assembly comprises an inner ring 6, and outer ring 5 and a ring spring 7 interposed between the two inner and outer rings.

During the rotation of the driven eccentric 4, those respective pistons 2 which are expelling the pressurized oil, to a small extent, can resiliently press against the outer ring 5, so that, at the start of a pressure thrust, occurring pressure spikes are permitted to be reduced in intensity. The ring spring bulges itself out from its seat by means of respectively the piston 2, which executes a direct pressure thrust. The piston draws in the pressure oil at its upper edge by means of corresponding intake openings in the cylinder.

The disadvantage of this conventional slip ring assembly, comprised of an inner ring 6, and outer ring 5 and the ring spring 7 is still the relatively heavy weight, which contributes to the inherent mass of the slip ring assembly 5, 6 and 7 causing an imbalance, which in turn leads to vibrations in the corresponding transmission.

Figure 2:
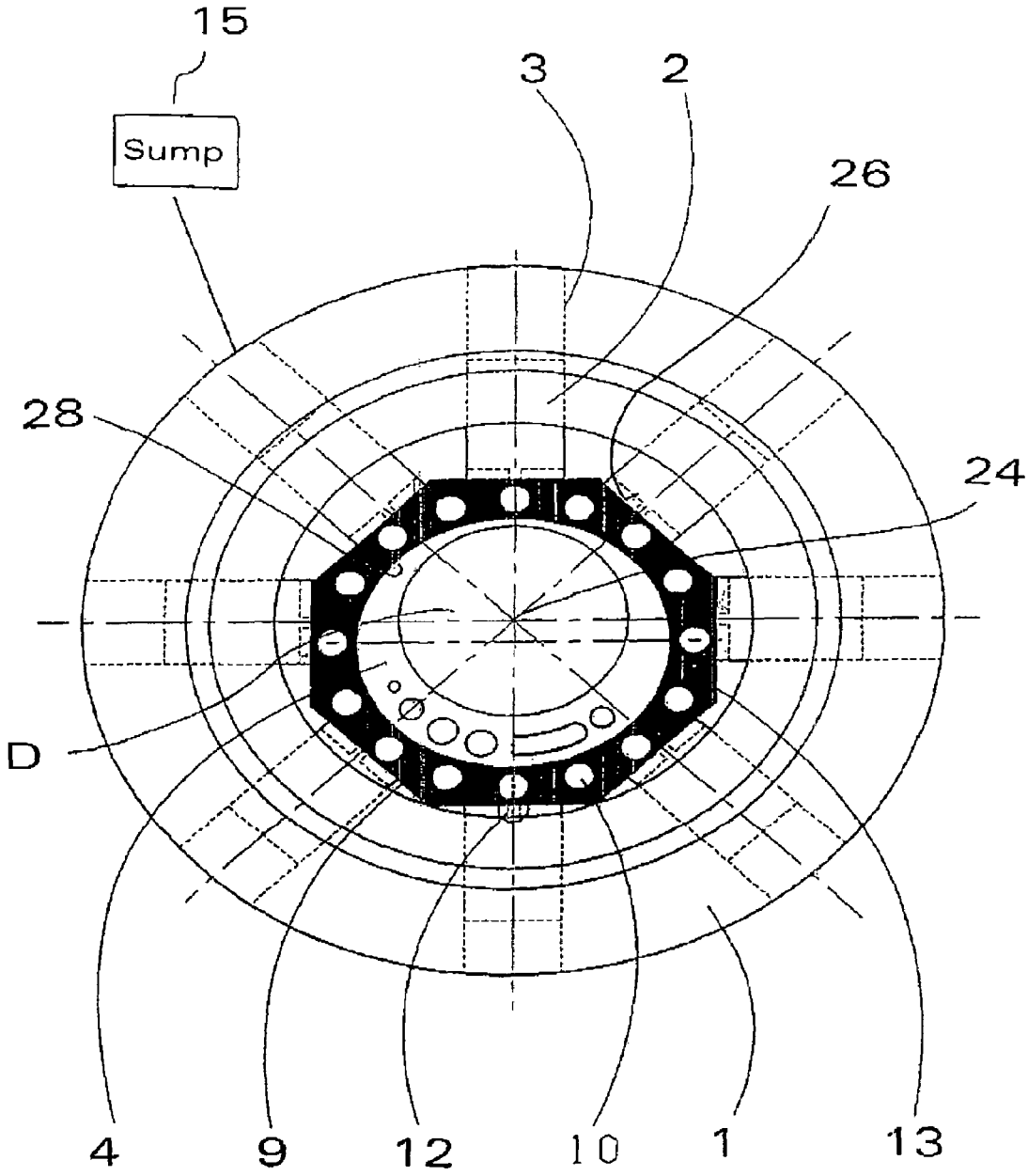
FIG. 2 shows a radial section through a radial piston pump in accord with the invention, with a slip ring assembly, which consists of a faceted slip ring.

In order to reduce this imbalance, the invention, instead of using the conventional slip ring assembly, provides a radial piston pump with a faceted slip ring as seen in FIG. 2. In FIG. 2, a pump body is again designated with the reference number 1, a piston with 2, a cylinder in the pump body 1 is designated by 3 and the driven eccentric is again shown as 4. Instead of a conventional slip ring assembly of inner ring, outer ring, and therebetween a ring spring, conversely, and in accord with the invention, a faceted slip ring 9 is employed which possesses a cylindrical inside surface 28 with a diameter and a polygonal diameter, whereby the polygon consists of straight, individual side (facet) surfaces 13 that extend parallel to the axis 24, and which are contiguously and angularly bound to one another. The number of the said side surfaces 13 conforms to the number of the pistons 2 in the corresponding radial piston pump.

The straight line, axis parallel surfaces 13, advantageously, are abrasively smoothed and form the contact surfaces for the pistons 2. This action permits the faceted slip ring 9 to be held in its position by the force of the compression springs of the pistons 2. The faceted slip ring 9 then follows only the designed motion of the driven eccentric 4 so that the rotary movement of said eccentric is converted to a translation movement of the pistons 2.

Upon a suction thrust of one of the pistons 2, by means of the intake port provided at the end of a corresponding cylinder 3 the fluid is drawn into said cylinder. Conversely, in the case of a pressure thrust of a piston 2, a pressure is generated in the cylinder chamber, which expels the fluid outward into a sump 15.

So that lubrication remains assured between the contacting surfaces of the pistons 2 and those of the faceted slip ring 9 during the operation, the piston bases 26 are centrally provided with a lubrication boring 12. This boring, among other features, achieves the advantage, that upon the buildup of pressure in the cylinder an additional damping is provided by the fluid between the faceted slip ring 9 and the base of the piston 2. Thereby, the same effect is attained as is the case of the conventional ring spring between the inner ring and the outer ring of the slip ring assembly of the state of the technology.

In order that the inherent weight of the faceted slip ring 9 may be held to the lowest possible value, a groove can be provided on both axially separated sides. Also, the said axially separated sides, can be penetrated by a multiplicity of circumferentially evenly apportioned, axial borings (the groove and the borings are only diagrammatically shown as element 10), whereby the number of such borings is determined by the required stability of the assembly.

As already mentioned above, with this reduced weight of the faceted slip ring a substantial imbalance reduction in the drive of radial piston pumps is made possible. Accompanying this is also a considerable increase of the efficiency because of both the reduced weight of the faceted slip ring and also the diminished sliding friction between the contacting surfaces of the pistons and the faceted slip ring. Additionally a better stability of the drive for the radial piston pump is attained, when compared with the conventional drive systems.

If, control edges (not shown) are provided on the straight, axially parallel surfaces 13, then it is possible to optionally adjust the pressure increase gradient and thereby also variably set the noise level as desired.

REFERENCE NUMBERS AND CORRESPONDING COMPONENTS

1 Pump body
2 Piston
3 Cylinder
4 Driven eccentric
5 Outer ring
6 Inner ring
7 Ring spring
8 Valve band
9 Faceted slip ring
10 Penetrating boring
11 Boring
12 Boring for lubrication
13 Straight, side surfaces of the faceted slip ring

The invention claimed is:

1. A radial piston pump comprising:

a pump body (1) having a plurality of cylinders (3) with each cylinder containing a reciprocating piston (2), each of the plurality of cylinders (3) and the pistons (2) being aligned along a respective radial axis extending normal to rotational axis (24) of the radial piston pump;

a slip ring assembly (9) comprising a radially inner cylindrical surface (28), a polygonal shaped radially outer surface having a plurality of radially outer planar surfaces (13) and a pair of opposed side surfaces, each of the radially outer planar surfaces (13) being engagable with only one of the pistons (2), and the slip ring assembly (9) further comprising at least one of:

a plurality of symmetrically located through bores (10) extending through the slip ring assembly (9) substantially parallel to the rotational axis (24) to reduce a weight of the slip ring assembly (9) without causing any imbalance of the slip ring assembly (9), and at least one symmetrically located bore (10), extends partially through the slip ring assembly (9), located in at least one of opposed side surfaces to reduce the weight of the slip ring assembly (9) without causing any imbalance of the slip ring assembly (9); and a driven eccentric (4) engaging the radially inner cylindrical surface (28) of the slip ring assembly (9) and being drivable about the rotational axis (24) such that each of the pistons (2) is sequentially biased between a suction thrust, during which fluid is drawn into the cylinder (3), and a pressure thrust, during which the fluid is expelled out of the cylinder (3) into a sump (15), and a number of the outer planar surfaces (13) is equal to a number of the pistons (2).

2. The radial piston pump according to claim 1, wherein the plurality of axially aligned through bores (10) are located in the slip ring assembly (9) at a common distance from a center of the slip ring assembly (9).

3. The radial piston pump according to claim 1, wherein the slip ring assembly (9) includes the plurality of axially aligned grooves (10) located in the slip ring assembly (9) at a common distance from a center of the slip ring assembly (9).

4. The radial piston pump according to claim 2, wherein the plurality of axially aligned through bores (10) are equally spaced apart from one another to form a ring of through bores (10) in the slip ring assembly (9).

5. The radial piston pump according to claim 3, wherein the plurality of axially aligned grooves (10) form a ring of grooves (10) in the slip ring assembly (9).

6. The radial piston pump according to claim 1, wherein the outer planar surfaces (13) are abrasively smoothed and form the contact surfaces for the pistons (2) which facilitates holding the slip ring assembly (9) in place by forces applied by springs which biase the pistons (2) toward the slip ring assembly (9) so that the slip ring assembly (9) only follows a designed motion of the driven eccentric (4) and rotary movement of the eccentric (4) is converted to a translation movement of the pistons (2).

7. The radial piston pump according to claim 1, wherein two surfaces of the slip ring assembly (9) are provided with a groove (11).

8. A radial piston pump comprising:

a drive shaft (D);

a pump body (1) having a plurality of cylinders (3) with each cylinder containing a reciprocating piston (2), each of the plurality of cylinders (3) and the pistons (2) being aligned along a respective radial axis extending normal to a rotational axis (24) of the radial piston pump;

a slip ring assembly (9) comprising a radially inner cylindrical surface (28), a polygonal shaped radially outer surface having a plurality of radially outer planar surfaces (13) and a pair of opposed side surfaces, each of the radially outer planar surfaces (13) being engagable with only one of the pistons (2), and the slip ring assembly (9) further comprising at least one of:

a plurality of symmetrically located through bores (10) extending through the slip ring assembly (9) substantially parallel to the rotational axis (24) to reduce a weight of the slip ring assembly (9) without causing any imbalance of the slip ring assembly (9), and at least one symmetrically located bore (10), extends partially through the slip ring assembly (9), located in at least one of the opposed side surfaces to reduce the weight of the slip ring assembly (9) without causing any imbalance of the slip ring assembly (9); and a driven eccentric (4) having an outwardly facing surface engaging the radially inner cylindrical surface (28) of the slip ring assembly (9) and an inwardly facing surface engaging with and being drivable by the drive shaft (D) about the rotational axis (24) such that each of the pistons (2) is sequentially biased between a suction thrust, during which fluid is drawn into the cylinder (3), and a pressure thrust, during which the fluid is expelled out of the cylinder (3) into a sump (15), and a number of the outer planar surfaces (13) is equal to a number of the pistons (2); and the outer planar surfaces (13) are abrasively smoothed and form the contact surfaces for the pistons (2) which facilitates holding the slip ring assembly (9) in place by forces applied by springs which biases the pistons (2) toward the slip ring assembly (9) so that the slip ring assembly (9) only follows a designed motion of the driven eccentric (4) and rotary movement of the eccentric (4) is converted to a translation movement of the pistons (2).

* * * * *